US009642434B2

(12) United States Patent
Hu

(10) Patent No.: US 9,642,434 B2
(45) Date of Patent: May 9, 2017

(54) TOUCH-SCREEN HAIRDRYER

(71) Applicant: Dongguan Furuikang Electrical Technology Co., Ltd., Dongguan (CN)

(72) Inventor: Haowen Hu, Dongguan (CN)

(73) Assignee: DONGGUAN FURUIKANG ELECTRICAL TECHNOLOGY CO., LTD., Dongguan (CN)

( * ) Notice: Subject to any disclaimer, the term of this patent is extended or adjusted under 35 U.S.C. 154(b) by 303 days.

(21) Appl. No.: 14/333,452

(22) Filed: Jul. 16, 2014

(65) Prior Publication Data

US 2015/0313340 A1 Nov. 5, 2015

(30) Foreign Application Priority Data

May 4, 2014 (CN) ..... 2014 1 0184683

(51) Int. Cl.
*A45D 20/30* (2006.01)
*A45D 20/12* (2006.01)
*A45D 20/00* (2006.01)

(52) U.S. Cl.
CPC ..... *A45D 20/30* (2013.01); *A45D 20/00* (2013.01); *A45D 20/12* (2013.01)

(58) Field of Classification Search
CPC ..... A45D 20/12; A45D 20/00; A45D 20/30
See application file for complete search history.

(56) References Cited

U.S. PATENT DOCUMENTS

2008/0284747 A1* 11/2008 Kuo ..... G06F 3/0202 345/173
2013/0291394 A1* 11/2013 Shami ..... A45D 20/10 34/88

* cited by examiner

*Primary Examiner* — Kenneth Rinehart
*Assistant Examiner* — Tavia Sullens
(74) *Attorney, Agent, or Firm* — Shimokaji IP

(57) ABSTRACT

A touch-screen hairdryer includes a touch screen and a control circuit, the touch screen is connected with the control circuit and arranged for receiving a touch signal from a user and then transmitting it to the control circuit, and the control circuit includes a wind speed adjusting circuit and a power adjusting circuit which are silicon controlled circuits arranged for adjusting wind speed and power according to the touch signal respectively. In comparison with the prior art, since the wind speed or power is adjusted by the silicon controlled rectifiers according to the touch signals inputted, thus a higher safety is obtained, and moreover the service life of the silicon controlled rectifiers is longer than the mechanical switch significantly.

7 Claims, 4 Drawing Sheets

TOUCH-SCREEN HAIRDRYER

RELATED APPLICATIONS

This application claims the benefit of priority to Chinese Patent Application No. 201410184683.0, filed on May 4, 2014, which is hereby incorporated by reference in its entirety.

FIELD OF THE INVENTION

The present invention relates to hairdryer, and more particularly to a touch-screen hairdryer.

BACKGROUND OF THE INVENTION

Hairdryers in the present market are commonly controlled by users through a mechanical switch (such as a key). For example, the users adjust wind speed or power by selecting a grade through the mechanical switch when adjusting wind speed or power.

However the conventional hairdryer with a mechanical switch has following problems. Firstly, the mechanical switch will strike fire, which may generate spark even, and lead to a low security accordingly; secondly, the mechanical switch has a limited service life.

Therefore, a touch-screen hairdryer is urgently needed to overcome above problems.

SUMMARY OF THE INVENTION

An objective of the present invention is to provide a touch-screen hairdryer, to replace mechanical switches by a touch screen and silicon controlled rectifiers, thereby improving safety of operation and service life of the switch.

To achieve the objective, a touch-screen hairdryer includes a touch screen and a control circuit, and the touch screen is connected with the control circuit and arranged for receiving a touch signal from a user and then transmitting it to the control circuit, and the control circuit includes a wind speed adjusting circuit and a power adjusting circuit which are silicon controlled circuits arranged for adjusting wind speed and power according to the touch signal respectively.

In comparison with the prior art, the touch-screen hairdryer according to the present invention includes a touch screen and a control circuit which includes a wind speed adjusting circuit and a power adjusting circuit. The touch screen transmits a touch signal to the control circuit after receiving the touch signal, thus the wind speed adjusting circuit can adjust wind speed through silicon controlled rectifiers according to the touch signal if the user wishes to adjust the wind speed, and the power adjusting circuit can adjust power through silicon controlled rectifiers according to the touch signal if the user wishes to adjust the power, thereby an adjustment for wind speed or power is realized. Furthermore, compared with the mechanical switch, since the wind speed or power is adjusted by the silicon controlled rectifiers according to the touch signals inputted, thus a higher safety is obtained, and moreover the service life of the silicon controlled rectifiers is longer than the mechanical switch significantly.

Preferably, the touch screen comprises a wind speed touching unit, a cold/hot wind touching unit and a power touching unit, the control circuit further comprises a central controlling circuit and a cold/hot wind selecting circuit, and the wind speed touching unit, the cold/hot wind touching unit, the power touching unit and the cold/hot wind selecting circuit are connected with input terminals of the central controlling circuit, and output terminals of the central controlling circuit are connected with the wind speed adjusting circuit and the power adjusting circuit.

Preferably, the touch screen further comprises a negative ion touching unit connected with the input terminals of the central controlling circuit, and the control circuit further comprises a negative ion adjusting circuit connected with the output terminals of the central controlling circuit so that an amount of negative ions generated can be controlled by the central controlling circuit.

Preferably, the central controlling circuit comprises a single chip microcomputer U1 and a filter capacitor C1, and a fifth pin of the single chip microcomputer U1 is grounded, a sixteenth pin of the single chip microcomputer U1 is connected with a power source of +5 volt that is connected with one terminal of the filter capacitor C1, and the other terminal of the filter capacitor C1 is grounded, a eighth pin, a ninth pin, a tenth pin, and a eleventh pin of the single chip microcomputer U1 are inputted signals G1, G2, G3, and G4 respectively, the signal G1 represents a hairdryer opening or closing signal, the signal G2 represents the touch signal inputted through the touch screen, the signal G3 represents a clock signal, and the signal G4 represents a BUSY signal, a sixth pin and a seventh pin of the single chip microcomputer U1 are connected with the cold/hot wind selecting circuit, a second pin of the single chip microcomputer U1 is connected with the wind speed adjusting circuit and the negative ion adjusting circuit, and a third pin of the single chip microcomputer U1 is connected with the power adjusting circuit.

Preferably, the central controlling circuit further comprises a voltage detecting circuit which includes a diode D1, a resistor R1, a resistor R2 and an optical coupler PC1, and a fourth pin of the optical coupler PC1 is connected with a first pin of the single chip microcomputer U1, a second pin and a third pin of the optical coupler PC1 are grounded, a first pin of the optical coupler PC1 is connected with one terminal of the resistor R2, and the other terminal of the resistor R2 is connected with one terminal of the resistor R1, and the other terminal of the resistor R1 is connected with a cathode of the diode D1, and an anode of the diode D1 is connected with an external power source.

Preferably, the wind speed adjusting circuit comprises a resistor R5, a resistor R6, a resistor R7, an optical coupler PC3, a silicon controlled rectifier T1 and a motor M, and a first pin of the optical coupler PC3 is connected with a power source VDD through the resistor R6, a second pin of the optical coupler PC3 is connected with the second pin of the single chip microcomputer U1, a fourth pin of the optical coupler PC3 is connected with a gate terminal G of the silicon controlled rectifier T1, a sixth pin of the optical coupler PC3 is connected with one terminal of the resistor R5 connected in parallel with the resistor R7, and the other terminal of the resistor R5 connected in parallel with the resistor R7 is connected with one of two main terminals of the silicon controlled rectifier T1 and one terminal of the motor M, the other terminal of two main terminals of the silicon controlled rectifier T1 is grounded, and the other terminal of the motor M is connected with the external power source.

Preferably, the power adjusting circuit comprises a resistor R3, a resistor R4, a resistor R8, an optical coupler PC2, a silicon controlled rectifier T2, a heating wire RH and a thermal switch TS, and a first pin of the optical coupler PC2 is connected with the power source VDD through the resistor R4, a second pin of the optical coupler PC2 is connected with the third pin of the single chip microcomputer U1, a fourth pin of the optical coupler PC2 is connected with a gate terminal G of the silicon controlled rectifier T2, a sixth pin of the optical coupler PC2 is connected with one terminal of the resistor R3 connected in parallel with the resistor R8, and the other terminal of the resistor R3 connected in parallel with the resistor R8 is connected with one of two main terminals of the silicon controlled rectifier T2 and one terminal of the heating wire RH, the other terminal of two main terminals of the silicon controlled rectifier T2 is grounded, the other terminal of the heating wire RH is connected with one terminal of the thermal switch TS, and the other terminal of the thermal switch TS is connected with the external power source.

Preferably, the cold/hot wind selecting circuit comprises a switch S1, and one terminal of the switch S1 is connected with the sixth pin of the single chip microcomputer U1, and the other terminal of the switch S1 is grounded.

Preferably, the negative ion adjusting circuit comprises a resistor R5, a resistor R6, a resistor R7, an optical coupler PC3, a silicon controlled rectifier T1 and a negative ion generator, and a first pin of the optical coupler PC3 is connected with a power source VDD through the resistor R6, a second pin of the optical coupler PC3 is connected with the second pin of the single chip microcomputer U1, a fourth pin of the optical coupler PC3 is connected with a gate terminal G of the silicon controlled rectifier T1, a sixth pin of the optical coupler PC3 is connected with one terminal of the resistor R5 connected in parallel with the resistor R7, and the other terminal of the resistor R5 connected in parallel with the resistor R7 is connected with one of two main terminals of the silicon controlled rectifier T1 and one terminal of the negative ion generator, the other terminal of two main terminals of the silicon controlled rectifier T1 is grounded, and the other terminal of the negative ion generator is connected with the external power source.

Preferably, the wind speed adjusting circuit has an adjustable wind speed grade of 16, the power adjusting circuit has an adjustable power grade of 16, and the negative ion adjusting circuit has an adjustable negative ion grade of 16.

The present invention will become more apparent from the following detailed description when taken in conjunction with the accompanying drawings used to illustrate embodiments of the invention.

DETAILED DESCRIPTION OF ILLUSTRATED EMBODIMENTS

Preferred embodiments of the present invention will be described taking in conjunction with the accompanying drawings below, and a similar component label in drawings refers to a similar component.

Figure 1:
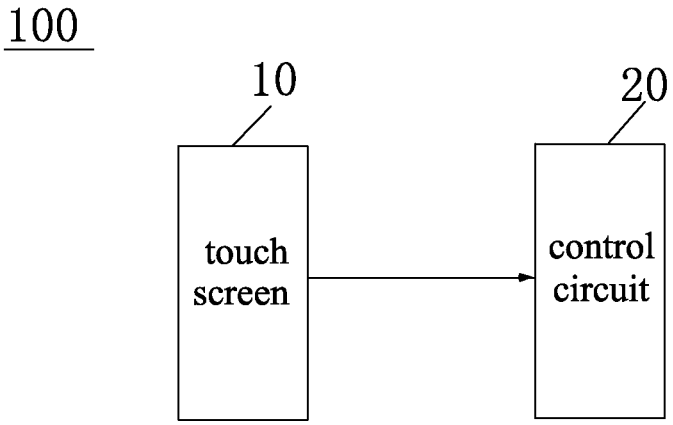
FIG. 1 is a frame diagram of the touch-screen hairdryer according to one embodiment of the present invention.

Please refer to FIG. 1, a touch-screen hairdryer 100 according to the present invention includes a touch screen 10 and a control circuit 20. Concretely, the touch screen 10 is connected with the control circuit 20 and arranged for receiving a touch signal from a user and then transmitting it to the control circuit 20, and the control circuit 20 includes a wind speed adjusting circuit 202 and a power adjusting circuit 204 which are silicon controlled circuits and arranged for adjusting wind speed and power according to the touch signal respectively.

In comparison with the prior art, since the wind speed or power is adjusted by the silicon controlled rectifiers according to the touch signals inputted through the touch screen, a higher safety is obtained and the operation is more easier, moreover the service life of the silicon controlled rectifiers is longer than the mechanical switch significantly.

Figure 2A:
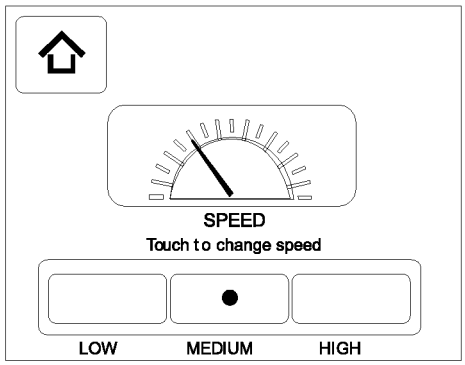
FIG. 2*a* is a schematic diagram of the touch screen 10 under a state of adjusting wind speed according to FIG. 1.
Figure 2B:
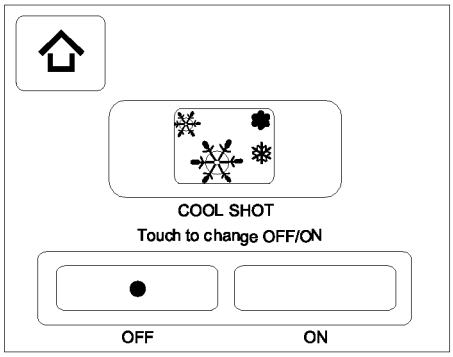
FIG. 2*b* is a schematic diagram of the touch screen 10 under a state of selecting cold/hot wind according to FIG. 1.
Figure 2C:
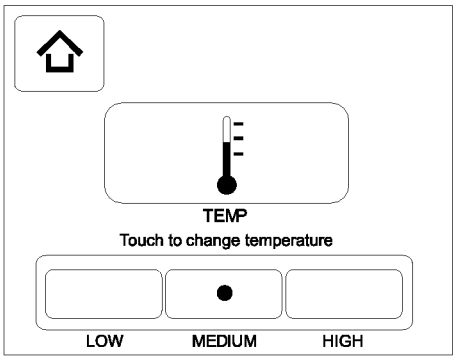
FIG. 2*c* is a schematic diagram of the touch screen 10 under a state of adjusting power according to FIG. 1.

Concretely, the touch screen 10 includes a wind speed touching unit 101, a cold/hot wind touching unit 102 and a power touching unit 103, which are showed in FIG. 2*a*, FIG. 2*b* and FIG. 2*c* respectively. The wind speed touching unit 101 refers to an interface of the touch screen 10 when it is used for adjusting wind speed, the cold/hot wind touching unit 102 refers to an interface of the touch screen 10 when it is used for selecting cold or hot wind, and the power touching unit 103 refers to an interface of the touch screen 10 when it is used for adjusting power. As shown in FIG. 2*a*, touching or sliding a pot in a rectangular box by the user realizes the function of wind speed adjusting. In addition, a pointer on the interface is used for synchronously displaying a current wind speed grade, and different positions of the pot in the rectangular box on the touch screen 10 represent different wind speed grades. It can be seen from FIG. 2*a* that compared with the prior art of having only two grades to select, the present invention realizes an adjustment for wind speed with 16 grades, thereby the range of wind speed grades to be selected by the user is broader. In the same way, as shown in FIG. 2*b*, the function of hot or cold wind selecting can be realized by touching or sliding the pot in the rectangular box to OFF or ON region. Concretely, if the user touches or slides the pot in the rectangular box to OFF region, the touch screen 10 will transmit a touch signal to the control circuit 20 to make the hairdryer output hot wind, otherwise, if the user touches or slides the pot in the rectangular box to ON region, the touch screen 10 will transmit a touch signal to the control circuit 20 to make the hairdryer output cold wind. In the same way, as shown in FIG. 2*c*, the function of power adjustment can be realized by touching or sliding a pot in a rectangular box. Furthermore, mercury on the interface is used for synchronously displaying a current power, and it can be seen from FIG. 2*c* that compared with the prior art of having only two grades to select, the present invention realizes an adjustment for power with 16 grades, thereby the range of power grades to be selected by the user is broader.

Figure 3:
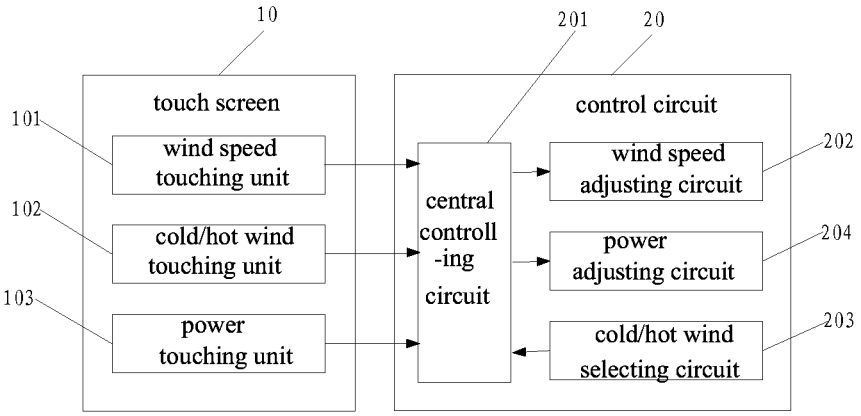
FIG. 3 is a detailed frame diagram of the touch screen 10 and the control circuit 20 according to FIG. 1.

Accordingly, as shown in FIG. 3, the control circuit 20 further includes a central controlling circuit 201 and a cold/hot wind selecting circuit 203. The wind speed touching unit 101, the cold/hot wind touching unit 102, the power touching unit 103 and the cold/hot wind selecting circuit 203 are connected with input terminals of the central controlling circuit 201, and output terminals of the central controlling circuit 201 are connected with the wind speed adjusting circuit 202 and the power adjusting circuit 204. Furthermore, the central controlling circuit 201 is arranged for controlling the wind speed adjusting circuit 202 to adjust wind speed according to the touch signal received from the wind speed touching unit 101, controlling the power adjusting circuit 204 to adjust power according to the touch signal received from the power touching unit 103, and selecting to output cold wind or hot wind according to the touch signal received from the cold/hot wind touching unit 102 or the status of the cold/hot wind selecting circuit 203.

Figure 2D:
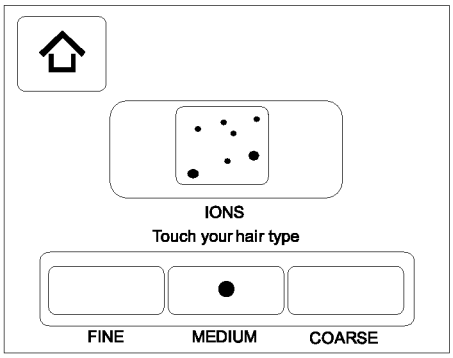
FIG. 2*d* is a schematic diagram of the touch screen 10 under a state of adjusting negative ion according to FIG. 1.
Figure 4:
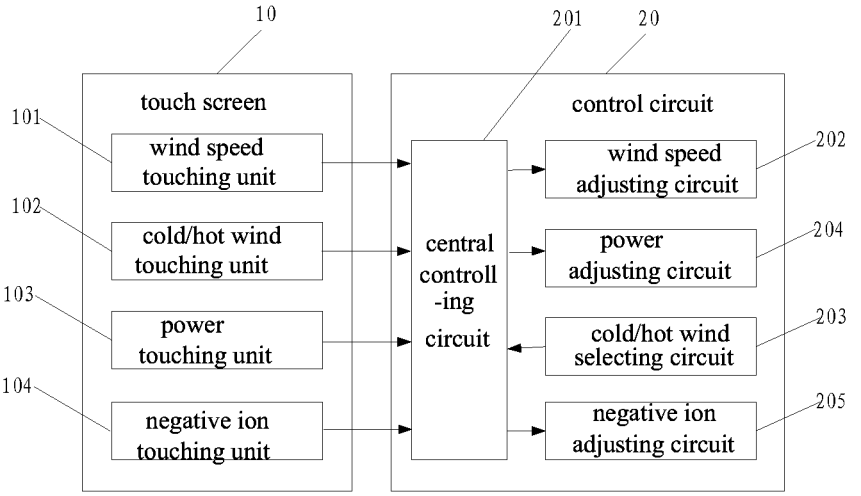
FIG. 4 is a frame diagram of the touch-screen hairdryer according to another embodiment of the present invention.
Figure 5:
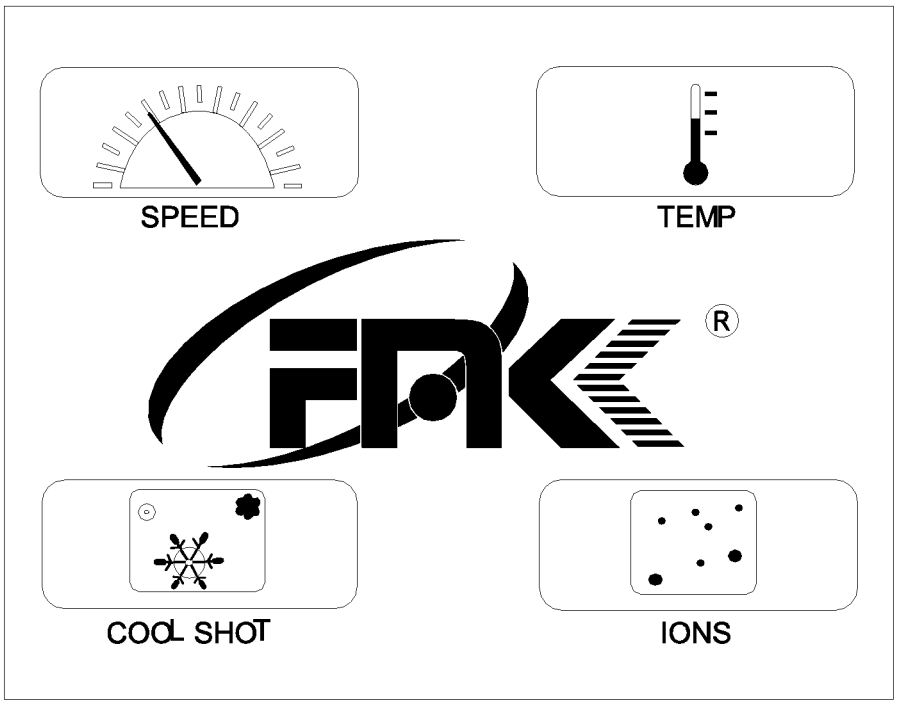
FIG. 5 is a schematic diagram of the touch screen 10 according to FIG. 4.

In addition, as shown in FIG. 4, the control circuit 20 further includes a negative ion adjusting circuit 205, and the touch screen 10 further includes a corresponding negative ion touching unit 104. The negative ion touching unit 104 is connected with the input terminals of the central controlling circuit 201, arranged for transmitting the touch signal to the central controlling circuit 201, and output terminals of the central controlling circuit 201 are connected with the negative ion adjusting circuit 205, arranged for controlling the negative ion adjusting circuit 205 to adjust amount of the negative ions generated according to the received touch signal. Moreover, as shown in FIG. 2*d*, the negative ion touching unit 104 refers to an interface of the touch screen 10 when it is used for adjusting the negative ion, and touching or sliding a pot in a rectangular box by the user realizes the function of amount adjusting for negative ions to generate, and the present invention realizes an adjustment for negative ion with 16 grades are available, thereby the range of negative ion grades to be selected by the user is broader. Besides, a schematic diagram of the touch screen 10 is showed in FIG. 5, including four submenus of wind speed adjusting, cold/hot wind selecting, power adjusting and negative ion adjusting, and the user may select any one of the submenus to enter.

Figure 6:
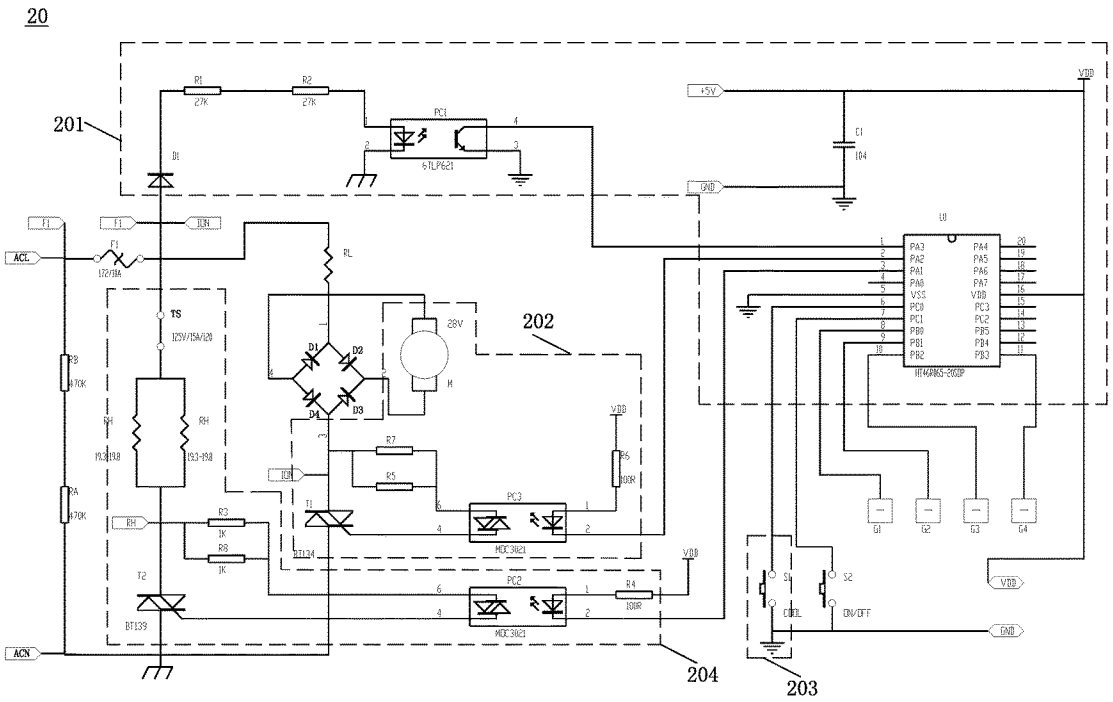
FIG. 6 is a circuit diagram of the control circuit 20 according to FIG. 4.

Then please refer to FIG. 6, showing a circuit diagram of the control circuit 20 according to FIG. 4. It is to be noted that the control circuit 20 according to this embodiment further includes an alternating current processing circuit and a power switch circuit. The alternating current processing circuit includes a fuse F1, a rectifier and filter circuit, a resistor RA, a resistor RB and a resistor RL. Concretely, the rectifier and filter circuit is made up of four diodes D1, D2, D3 and D4 whose model is IN4007, and the four diodes D1, D2, D3 and D4 are connected to form a bridge rectifier and filter circuit. More specifically, anodes of the diode D1 and diode D4 are connected together to form one terminal 4, a cathode of the diode D1 and an anode of the diode D2 are connected together to form one terminal 1, cathodes of the diode D2 and diode D3 are connected together to form one terminal 2, a cathode of the diode D4 and an anode of the diode D3 are connected together to form one terminal 3, and one terminal of the fuse F1 is connected with a live wire of the alternating current through an interface ACL showed in FIG. 6, the other terminal of the fuse F1 is connected with one terminal of the resistor RL, and the other terminal of the resistor RL is connected with the terminal 1 of the rectifier and filter circuit, and one terminal of the resistor RA and RB connected in series is connected with the live wire of the alternating current, the other terminal of the resistor RA and RB connected in series is connected with the neutral wire of the alternating current. Besides, the power switch circuit includes a switch S2 whose one terminal is connected with the central controlling circuit 201 and the other terminal is grounded. Power source is supplied if the switch S2 is pressed.

As shown in FIG. 6, the central controlling circuit 201 includes a single chip microcomputer U1, a filter capacitor C1 and a voltage detecting circuit which includes a diode D1, a resistor R1, a resistor R2 and an optical coupler PC1. Concretely, a forth pin of the optical coupler PC1 is connected with a first pin of the single chip microcomputer U1, a second pin and a third pin of the optical coupler PC1 are grounded, a first pin of the optical coupler PC1 is connected with one terminal of the resistor R2, and the other terminal of the resistor R2 is connected with one terminal of the resistor R1, and the other terminal of the resistor R1 is connected with a cathode of the diode D1, and an anode of the diode D1 is connected with an external power source. Furthermore, the anode of the diode D1 is connected with one terminal of the fuse F1, and the other terminal of the fuse F1 is connected with the live wire of the alternating current. And the voltage detecting circuit is arranged for detecting whether the voltage inputted is high or low. The model of the single chip microcomputer U1 in this embodiment is HT46R065, and moreover, a fifth pin of the single chip microcomputer U1 is grounded, a sixteenth pin of the single chip microcomputer U1 is connected with a power source of +5 volt that is connected with one terminal of the filter capacitor C1, and the other terminal of the filter capacitor C1 is grounded, an eighth pin, a ninth pin, a tenth pin, and an eleventh pin of the single chip microcomputer U1 are inputted signals G1, G2, G3 and G4 respectively, the signal G1 represents a hairdryer opening or closing signal, the signal G2 represents the touch signal inputted through the touch screen 10, the signal G3 represents a clock signal, the signal G4 represents a BUSY signal, and the BUSY refers to a communication detecting pin used for detecting work status of a communication pin. In addition, a sixth pin of the single chip microcomputer U1 is connected with the cold/hot wind selecting circuit 203, a second pin of the single chip microcomputer U1 is connected with the wind speed adjusting circuit 202 and the negative ion adjusting circuit 205, a third pin of the single chip microcomputer U1 is connected with the power adjusting circuit 204, and a seventh pin of the single chip microcomputer U1 is connected with the power switch circuit, that is the seventh pin of the single chip microcomputer U1 is connected with a switch S2.

As shown in FIG. 6, the wind speed adjusting circuit 202 includes a resistor R5, a resistor R6, a resistor R7, an optical coupler PC3, a silicon controlled rectifier T1 and a motor M. Concretely, a first pin of the optical coupler PC3 is connected with a power source VDD through the resistor R6, a second pin of the optical coupler PC3 is connected with the second pin of the single chip microcomputer U1, a forth pin of the optical coupler PC3 is connected with a gate terminal G of the silicon controlled rectifier T1, a sixth pin of the optical coupler PC3 is connected with one terminal of the resistor R5 connected in parallel with the resistor R7, and the other terminal of the resistor R5 connected in parallel with the resistor R7 is connected with one of two main terminals of the silicon controlled rectifier T1 and the external power source, the other terminal of two main terminals of the silicon controlled rectifier T1 is grounded by connected to neutral wire of the alternating current through an interface ACN showed in FIG. 6. More specifically, the terminal 2 and terminal 4 of the rectifier and filter circuit are connected with two terminals of the motor M respectively, and the terminal 3 of the rectifier and filter circuit is connected with the other terminal of the resistor R5 connected in parallel with the resistor R7.

When adjusting wind speed, the user select the submenu of "wind speed adjusting" through the touch screen 10 firstly, and then the touch screen 10 displays an interface as showed in FIG. 2*a*. At this time, touching or sliding a pot in a rectangular box on the touch screen 10 by the user generates a touch signal of wind speed adjusting and then the touch signal is inputted to the single chip microcomputer U1 through the ninth pin of the single chip microcomputer U1, wherein different positions of the pot represent different touch signals of wind speed adjusting, then the single chip microcomputer U1 processes the touch signal of wind speed adjusting and outputs a corresponding control signal to the optical coupler PC3 through the second pin of the single chip microcomputer U1, and the optical coupler PC3 controls the guide circuit angle whose size corresponds to different output voltages that deciding speed of the motor M of the silicon controlled rectifier T1, thereby realizing an adjustment for wind speed. That is the user realizes the adjustment for wind speed by touching or sliding the pot in the rectangular box on the touch screen 10 to different positions. Besides, the rectangular box according to this embodiment is divided into 16 small regions indicating 16 wind speed grades, namely dividing the range from a maximum wind speed to a minimum wind speed into 16 grades to obtain a more elaborate division, as a result, it's desirable for the user to chose comfortable wind speed, thereby supplying a better experience to the user.

As shown in FIG. 6, the cold/hot wind selecting circuit 203 includes a switch S1, and one terminal of the switch S1 is connected with a sixth pin of the single chip microcomputer U1, and the other terminal of the switch S1 is grounded. Concretely, hairdryer outputs cold wind if the user pressed the switch S1, otherwise outputs hot wind. In addition, selecting cold/hot wind can be realized by touching operations on the touch screen 10 besides through the switch S1. Specifically, the hairdryer outputs cold wind if the user touching or sliding the pot in the rectangular box to ON region, otherwise, outputs hot wind if the user touching or sliding the pot in the rectangular box to OFF region.

A process for realizing the cold/hot wind selecting by touching operations will be specifically described following.

When selecting cold wind or hot wind, the user select the submenu of "cold or hot wind selecting" through the touch screen 10 firstly, and then the touch screen 10 displays an interface as showed in FIG. 2*b*. At this time, touching or sliding the pot in the rectangular box on the touch screen 10 to ON or OFF region realizes a selection for cold wind or hot wind. Concretely, the hairdryer outputs cold wind if the user touching or sliding the pot in the rectangular box to ON region, otherwise, outputs hot wind if the user touching or sliding the pot in the rectangular box to OFF region. Specifically, a touch signal transmits to the single chip microcomputer U1 through the ninth pin of the single chip microcomputer U1 after the user touching the ON region, then the single chip microcomputer U1 processes the touch signal and outputs a corresponding control signal to the optical coupler PC2 through the third pin of the single chip microcomputer U1, and the optical coupler PC2 controls the silicon controlled rectifier T2 to cut off so that there is no voltage between two ends of a heating wire RH, thereby the heat wire RH generates no heat and then the hairdryer outputs cold wind. Otherwise, a touch signal transmits to the single chip microcomputer U1 through the ninth pin of the single chip microcomputer U1 after the user touching the OFF region, then the single chip microcomputer U1 processes the touch signal and outputs a corresponding control signal to the optical coupler PC2 through the third pin of the single chip microcomputer U1, and the optical coupler PC2 controls the silicon controlled rectifier T2 to work so that there is a voltage between two ends of the heating wire RH, thereby the heat wire RH heats to generate power and then the hairdryer outputs hot wind.

As shown in FIG. 6, the power adjusting circuit 204 includes a resistor R3, a resistor R4, a resistor R8, an optical coupler PC2, a silicon controlled rectifier T2, a heating wire RH and a thermal switch TS. Concretely, a first pin of the optical coupler PC2 is connected with a power source VDD through the resistor R4, a second pin of the optical coupler PC2 is connected with the third pin of the single chip microcomputer U1, a forth pin of the optical coupler PC2 is connected with a gate terminal G of the silicon controlled rectifier T2, a sixth pin of the optical coupler PC2 is connected with one terminal of the resistor R3 connected in parallel with the resistor R8, and the other terminal of the resistor R3 connected in parallel with the resistor R8 is connected with one of two main terminals of the silicon controlled rectifier T2 and one terminal of the heating wire RH, the other terminal of two main terminals of the silicon controlled rectifier T2 is grounded, the other terminal of the heating wire RH is connected with one terminal of the thermal switch TS, and the other terminal of the thermal switch TS is connected with the external power source. More specifically, the other terminal of the thermal switch TS is connected with one terminal of the fuse F1, and the other terminal of the fuse F1 is connected with the live wire of the alternating current.

When adjusting power, the user select the submenu of "power adjusting" through the touch screen 10 firstly, and then the touch screen 10 displays an interface as showed in FIG. 2*c*. At this time, touching or sliding a pot in a rectangular box on the touch screen 10 by the user generates a touch signal of power adjusting and then the touch signal is inputted to the single chip microcomputer U1 through the ninth pin of the single chip microcomputer U1, wherein different positions of the pot represent different touch signals of power adjusting, then the single chip microcomputer U1 processes the touch signal of adjusting power and outputs a corresponding control signal to the optical coupler PC2 through the third pin of the single chip microcomputer U1, and the optical coupler PC2 controls the guide circuit angle whose size corresponds to different output voltages that deciding a voltage between two terminals of the heating wire RH of the silicon controlled rectifier T2, thereby realizing an adjustment for power. That is the user realizes the adjustment for power by touching or sliding the pot in the rectangular box on the touch screen 10 to different positions. Besides, the rectangular box according to this embodiment is divided into 16 grades indicating 16 power grades, namely dividing the range from a maximum power to a minimum power into 16 grades to obtain a more elaborate division, as a result, it's desirable for the user to chose comfortable power, thereby supplying a better experience to the user.

As shown in FIG. 6, the negative ion adjusting circuit 205 includes a resistor R5, a resistor R6, a resistor R7, an optical coupler PC3, a silicon controlled rectifier T1 and a negative ion generator (not shown in figures). Concretely, a first pin of the optical coupler PC3 is connected with the power source VDD through the resistor R6, a second pin of the optical coupler PC3 is connected with the second pin of the single chip microcomputer U1, a forth pin of the optical coupler PC3 is connected with a gate terminal G of the silicon controlled rectifier T1, a sixth pin of the optical coupler PC3 is connected with one terminal of the resistor R5 connected in parallel with the resistor R7, and the other terminal of the resistor R5 connected in parallel with the resistor R7 is connected with one of two main terminals of the silicon controlled rectifier T1 and one terminal of the negative ion generator, the other terminal of two main terminals of the silicon controlled rectifier T1 is grounded, and the other terminal of the negative ion generator is connected with the external power source. More specifically, the other terminal of the negative ion generator is connected with one terminal of the fuse F1, and the negative ion generator is connected between two ports ION showed in FIG. 6.

When adjusting negative ion, the user selects the submenu of "negative ion adjusting" through the touch screen 10 firstly, and then the touch screen 10 displays an interface as showed in FIG. 2*d*. At this time, touching or sliding a pot in a rectangular box on the touch screen 10 by the user generates a touch signal of negative ion adjusting and then the touch signal is inputted to the single chip microcomputer U1 through the ninth pin of the single chip microcomputer U1, wherein different positions of the pot represent different touch signals of negative ion adjusting, then the single chip microcomputer U1 processes the touch signal of negative ion adjusting and outputs a corresponding control signal to the optical coupler PC3 through the second pin of the single chip microcomputer U1, and the optical coupler PC3 controls the guide circuit angle whose size corresponds to different output voltage that deciding the amount of negative ions generated of the silicon controlled rectifier T1, thereby realizing an adjustment for negative ion. That is the user realizes the adjustment for negative ion by touching or sliding the pot in the rectangular box on the touch screen 10 to different positions. Besides, the rectangular box according to this embodiment is divided into 16 small regions indicating 16 negative ion grades, namely dividing the range from a maximum negative ion to a minimum negative ion into 16 grades to obtain a more elaborate division, as a result, it's desirable for the user to chose comfortable wind speed, thereby supplying a better experience to the user.

In this embodiment, model of the optical coupler PC1 is 6TLP621, model of the optical coupler PC3 and PC2 is MOC3021, model of the silicon controlled rectifier T1 is BT134, model of the silicon controlled rectifier T2 is BT139, model of the diode D1 is IN4007, value of the resistor RA and RB is 470 k Ohm, value of the resistor R1 and R2 is 27 k Ohm, rated temperature of the fuse F1 is 172 degrees and rated current of the fuse F1 is 10 amperes.

It can be seen from above description that compared with the mechanical switch, since the wind speed or power is adjusted by the silicon controlled rectifiers according to the touch signals inputted through the touch screen, thus a higher safety is obtained and the operation is more easier, moreover the service life of the silicon controlled rectifiers is longer than the mechanical switch significantly.

While the present invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A touch-screen hairdryer, comprising a touch screen and a control circuit, wherein the touch screen is connected with the control circuit and arranged for receiving a touch signal from a user and then transmitting it to the control circuit, and the control circuit comprises a wind speed adjusting circuit and a power adjusting circuit which are silicon controlled circuits and arranged for adjusting wind speed and power according to the touch signal respectively;

wherein the touch screen comprises a wind speed touching unit, a cold/hot wind touching unit and a power touching unit, the control circuit further comprises a central controlling circuit and a cold/hot wind selecting circuit, and the wind speed touching unit, the cold/hot wind touching unit, the power touching unit and the cold/hot wind selecting circuit are connected with input terminals of the central controlling circuit, and output terminals of the central controlling circuit are connected with the wind speed adjusting circuit and the power adjusting circuit;

the touch screen further comprises a negative ion touching unit connected with the input terminals of the central controlling circuit, and the control circuit further comprises a negative ion adjusting circuit connected with the output terminals of the central controlling circuit so that an amount of negative ions generated can be controlled by the central controlling circuit;

the central controlling circuit comprises a single chip microcomputer (U1) and a filter capacitor (C1), and a fifth pin of the single chip microcomputer (U1) is grounded, a sixteenth pin of the single chip microcomputer (U1) is connected with a power source of +5 volt that is connected with one terminal of the filter capacitor (C1), and the other terminal of the filter capacitor (C1) is grounded, an eighth pin, a ninth pin, a tenth pin, and an eleventh pin of the single chip microcomputer (U1) are inputted signals (G1, G2, G3, and G4) respectively, the signal (G1) represents a hairdryer turn-on or turn-off signal, the signal (G2) represents the touch signal inputted through the touch screen, the signal (G3) represents a clock signal, and the signal (G4) represents a BUSY signal, a sixth pin and a seventh pin of the single chip microcomputer (U1) are connected with the cold/hot wind selecting circuit, a second pin of the single chip microcomputer (U1) is connected with the wind speed adjusting circuit and the negative ion adjusting circuit, and a third pin of the single chip microcomputer (U1) is connected with the power adjusting circuit.

2. The touch-screen hairdryer according to claim 1, wherein the central controlling circuit further comprises a voltage detecting circuit which includes a diode (D1), a resistor (R1), a resistor (R2) and an optical coupler (PC1), and a fourth pin of the optical coupler (PC1) is connected with a first pin of the single chip microcomputer (U1), a second pin and a third pin of the optical coupler (PC1) are grounded, a first pin of the optical coupler (PC1) is connected with one terminal of the resistor (R2), and the other terminal of the resistor (R2) is connected with one terminal of the resistor (R1), and the other terminal of the resistor (R1) is connected with a cathode of the diode (D1), and an anode of the diode (D1) is connected with an external power source.

3. The touch-screen hairdryer according to claim 1, wherein the wind speed adjusting circuit comprises a resistor (R5), a resistor (R6), a resistor (R7), an optical coupler (PC3), a silicon controlled rectifier (T1) and a motor (M), and a first pin of the optical coupler (PC3) is connected with a power source (VDD) through the resistor (R6), a second pin of the optical coupler (PC3) is connected with the second pin of the single chip microcomputer (U1), a fourth pin of the optical coupler (PC3) is connected with a gate terminal (G) of the silicon controlled rectifier (T1), a sixth pin of the optical coupler (PC3) is connected with one terminal of the resistor (R5) connected in parallel with the resistor (R7), and the other terminal of the resistor (R5) connected in parallel with the resistor (R7) is connected with one of two main terminals of the silicon controlled rectifier (T1) and one terminal of the motor (M), the other terminal of two main terminals of the silicon controlled rectifier (T1) is grounded, and the other terminal of the motor (M) is connected with an external power source.

4. The touch-screen hairdryer according to claim 1, wherein the power adjusting circuit comprises a resistor (R3), a resistor (R4), a resistor R8 (R8), an optical coupler (PC2), a silicon controlled rectifier (T2), a heating wire (RH) and a thermal switch (TS), and a first pin of the optical coupler (PC2) is connected with the power source (VDD) through the resistor (R4), a second pin of the optical coupler (PC2) is connected with the third pin of the single chip microcomputer (U1), a fourth pin of the optical coupler (PC2) is connected with a gate terminal (G) of the silicon controlled rectifier (T2), a sixth pin of the optical coupler (PC2) is connected with one terminal of the resistor (R3) connected in parallel with the resistor (R8), and the other terminal of the resistor (R3) connected in parallel with the resistor (R8) is connected with one of two main terminals of the silicon controlled rectifier (T2) and one terminal of the heating wire (RH), the other terminal of two main terminals of the silicon controlled rectifier (T2) is grounded, the other terminal of the heating wire (RH) is connected with one terminal of the thermal switch (TS), and the other terminal of the thermal switch (TS) is connected with an external power source.

5. The touch-screen hairdryer according to claim 1, wherein the cold/hot wind selecting circuit comprises a switch (S1), and one terminal of the switch (S1) is connected with the sixth pin of the single chip microcomputer (U1), and the other terminal of the switch (S1) is grounded.

6. The touch-screen hairdryer according to claim 1, wherein the negative ion adjusting circuit comprises a resistor (R5), a resistor (R6), a resistor (R7), an optical coupler (PC3), a silicon controlled rectifier (T1) and a negative ion generator, and a first pin of the optical coupler (PC3) is connected with a power source (VDD) through the resistor (R6), a second pin of the optical coupler (PC3) is connected with the second pin of the single chip microcomputer (U1), a fourth pin of the optical coupler (PC3) is connected with a gate terminal (G) of the silicon controlled rectifier (T1), a sixth pin of the optical coupler (PC3) is connected with one terminal of the resistor (R5) connected in parallel with the resistor (R7), and the other terminal of the resistor (R5) connected in parallel with the resistor (R7) is connected with one of two main terminals of the silicon controlled rectifier (T1) and one terminal of the negative ion generator, the other terminal of two main terminals of the silicon controlled rectifier (T1) is grounded, and the other terminal of the negative ion generator is connected with an external power source.

7. The touch-screen hairdryer according to claim 1, wherein the wind speed adjusting circuit has an adjustable wind speed grade of 16, the power adjusting circuit has an adjustable power grade of 16, and the negative ion adjusting circuit has an adjustable negative ion grade of 16.

* * * * *